United States Patent [19]

Silence et al.

[11] Patent Number: 4,886,390

[45] Date of Patent: Dec. 12, 1989

[54] LOOSE LEAF BINDER

[76] Inventors: Joseph A. Silence, 9742 Pebble Beach Dr.; Randolph Torres, 9747 Pebble Beach Dr., both of Santee, Calif. 92071

[21] Appl. No.: 258,516

[22] Filed: Oct. 17, 1988

[51] Int. Cl.[4] ..... B42F 3/00; B42F 13/00; B42F 5/00; B42F 13/20

[52] U.S. Cl. ..... 402/80 R; 402/29; 402/42; 402/43

[58] Field of Search ..... 402/13, 14, 16, 17, 402/24, 25, 29, 30, 31, 41, 42, 43, 73, 74, 75, 80 R, 500, 29, 42, 43, 80 R; 411/337-346, 508, 509, 510, 549-552

[56] References Cited

U.S. PATENT DOCUMENTS

| | | | |
|---|---|---|---|
| 924,492 | 6/1909 | Nicholson | 402/42 |
| 1,807,390 | 5/1931 | Crosby | 402/43 |
| 2,909,179 | 10/1959 | Robbins | 402/31 |
| 2,957,477 | 10/1960 | MacLean | 402/43 |

FOREIGN PATENT DOCUMENTS

| | | | |
|---|---|---|---|
| 32299 | 1/1905 | Switzerland | 402/29 |
| 161383 | 4/1921 | United Kingdom | 402/42 |
| 365295 | 12/1937 | United Kingdom | 402/14 |

*Primary Examiner*—Douglas D. Watts
*Assistant Examiner*—Paul M. Heyrana, Sr.
*Attorney, Agent, or Firm*—Frank D. Gilliam

[57] ABSTRACT

The invention is directed to a loose leaf type ring binder having two long sides and a designated top and bottom for temporarily attaching perforated papers or the like to a file or folder. A pair of rings are loosely attached to the file or folder near the designated top in a manner so that they are free to pivot relative to the sides of the folder through substantially 180 degrees to a position substantially parallel with the surface of the folder or file in either direction of pivot. The opening through the center of the rings being positioned perpendicular to the designated top and bottom. Each of the rings are split and provided with a hinge so that the rings can be opened at the split to receive perforations in the papers to the attached thereto. The rings include a locking device at the ends of the split to prevent unwanted opening of the rings at the split and stops to prevent circumferential rotation of the rings relative to the file or folder.

6 Claims, 1 Drawing Sheet

LOOSE LEAF BINDER

BACKGROUND OF THE INVENTION

The invention is directed to ring binders and more particularly to binders in which the rings are pivotally secured upon the surface of a file folder or the like and can be pivoted to a position substantially parallel with the surface of the file folder or the like and are provided each with a split and a hinged section, by opening the rings at the split perforated sheets of paper or the like can be inserted and removed therefrom.

The present invention is adapted for use in file folders or the like which require a plurality of papers to be attached, removed and stored in a conventional file drawer with a minimum of thickness.

Conventional ring binders with hard backs which fold one over the other are well known and have been used by school children to maintain order to their school papers for many years. Binders of this type have a fixed thickness regardless of the quantity of papers held thereby. Binders of this general type can be found in U.S. Pat. Nos. 625,050; 641,705 and 4,722,627.

Improvements for holding papers in a flat folder by means of a flat metal base member which is bendable at its ends so that the ends can be bent and passed through apertures in the file cover onto which perforated papers can then be inserted and held in place by further bending of the ends toward each other is well known in the art. This type of fastener although being universally employed for file folders has a severe drawback in that to retrieve a paper filed thereon positioned near the bottom of a stack of now filed papers all of the papers positioned above the desired one must first be removed and in most instances the stack must be replaced on the now bent up ends of the fastener one at a time in reverse order to maintain their chronological position. Various fastener devices of this type are taught by U.S. Pat. Nos. 1,577,558; 1,652,205 and 4,285,104.

U.S. Pat. No. 4,174,909 teaches a flexible strap paper attachment means which forms an integral portion of the cover. This type fastening means like the fasting device discussed immediately above requires that all papers held by the strap must first be removed before the desired paper can be removed and then replaced one at a time in order.

There has not been a ring type binder for use in a file folder or the like which only has the overall thickness of the contents therein at any given time and that will allow the removal of a selected paper therefrom without adjacent paper removal regardless of the position of the selected paper in a stack of adjacent papers until the emergence of the present invention.

SUMMARY OF THE INVENTION

This invention is directed to a ring type binder that can be used in conjunction with file folders or the like which will maintain an overall thickness that is substantially the same thickness as the contents therein and from which a selected previously filed paper can be removed therefrom without the prior removal of any other adjacent paper or papers.

The invention comprises a pair of split rings similar to the rings used in a conventional loose leaf binder. The rings pivot open at a split to allow the insertion of perforations through papers and the like to be filed. The distance between the perforations match the distance between the rings. The rings are attached to the folder or the like in a manner which allows them to freely pivot from side to side in either direction through substantially 180 degrees toward the surface of the folder to a position substantially parallel to the surface thereof. In the preferred embodiment, the rings are held in place by means of a fastener with bendable ends similar to those discussed above. The equivalent normal base or bottom surface of the bendable fastener discussed above is used as the top surface of the fastener means for holding the rings. Bores are formed in the base or now top surface of the bendable fastener. The center line of the bores are parallel with the sides of the folder or the like and to each other and perpendicular to the top and bottom surface thereof. The rings are loosely held in place in the bores which enables them to pivot relative to the bores toward either side of the folder or the like. Stops are located on the ring adjacent to each end of the bore to prevent the rings from rotating circumferentially relative to the bore. As shown in the drawing Figures, the ring pivot or hinge forms one of the stops and a raised protrusion forms the other stop. It should be understood that the stops can take any form so long as the intent of the stops is satisfied.

As papers are stored on the rings the rings can be pivoted in the same direction so that the overall thickness of the file, papers and rings is substantially the same as the thickness of the papers and the file. To remove filed papers the rings are pivoted to a position perpendicular to the folder surface as in a conventional loose leaf binder and the papers can then be removed from the rings in the same manner as from a conventional loose leaf binder.

It is an object of this invention to provide a lose leaf type binder wherein the rings can be pivoted toward the surface of the file folder so that the overall thickness of the loose leaf binder is substantially the same thickness as the papers held thereby.

It is another object of this invention to provide a loose leaf binder which can provide a minimum total thickness and yet allow a selected paper held thereby to be removed without first removing any adjacent papers held thereby.

Further and other objects and advantages of the invention will be seen by those skilled in the art from the following drawings and detailed description of the preferred embodiment.

DETAILED DESCRIPTION OF THE PREFERRED EMBODIMENT

Figure 1:
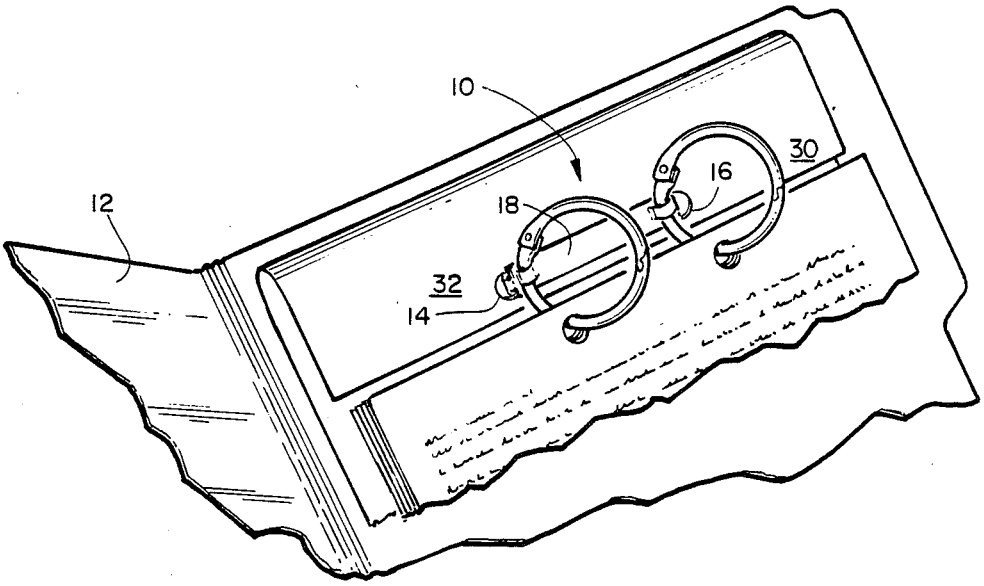
FIG. 1 is an elevated perspective showing of the loose leaf ring binder of the invention wherein the paper hoding rings are pivoted for file storage.
Figure 2:
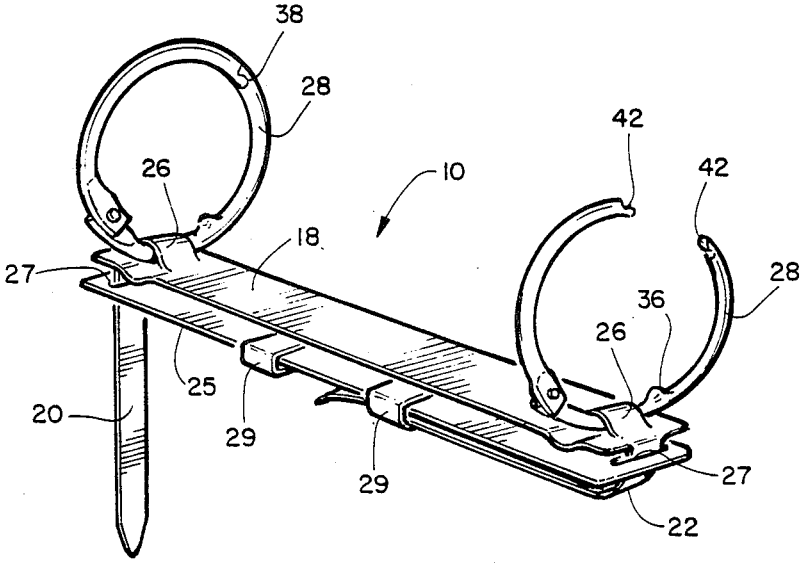
FIG. 2 is an elevated perspective showing of the fastening device with one of the ends thereof folded for securing the device to the folder.

Referring now to the drawing Figures in detail. In FIG. 1, the fastening device 10 of the invention is shown attached for use on a conventional file folder 12. It should be understood that the fastener device of the invention can be attached for use on any suitable flat surface and the attachment to the file folder is for the purpose of discussion only and not as a limitation to the use of the fastener device 10. The file folder has a pair of spaced apart apertures 14 and 16. A fastener base 18 has bendable ends 20 and 22. Both ends are bent substantially 90 degrees relative to the fastener base 18 at a distance from each other equal to the spacing between the apertures 14 and 16, inserted through spaced apart apertures and the ends are bent further toward eaoh other to a position substantially parallel to the under surface 24 of the file folder. A metal plate 25, with apertures configured to accept the ends of the base member can be slipped over the ends 20 and 22 after insertion through the apertures 27 if desired to prevent tearing of the file folder after prolonged use and then the ends can be bent over as above discussed and held in place by conventional translatable metal loop 29. Metal plates of this type are well known in the art.

The fastener base 18 has a pair of tubular elongated bores 26 formed thereon for receiving a split ring 28 therethrough. The center lines of the bores 26 are parallel to each other and transverse to the bendable ends of the fastener base. When inserted therethrough, the split rings are free to pivot toward the sides 30 and 32 of the folder. As can be seen in FIG. 1, the rings are normally pivoted in the same direction when in use. The rings are however prevented from rotating longitudinally relative to the bores by means of a pair of stops 34 and 36. The rings have a split 38 along their circumference whereby the ring 28 can be opened by pivoting at pivot or hinge 40. Stop member 34 is shown provided by the increased thickness of the ring at the pivot or hinge 40. It should be understood that the pivot or hinge 40 can be located at a location away from the bores 26 and a stop member like stop member 36 hereinafter discussed can be used equally as well. Stop member 36 is provided by increasing the diameter of the ring to an amount greater that the diameter of the bore 26 thereby preventing the stop from passing through the bore. This increased diameter can be provide by any means such as, for example, a spot of welding material or the like or a flattened area formed on the ring surface after the ring has been inserted into the bore.

Figure 3:
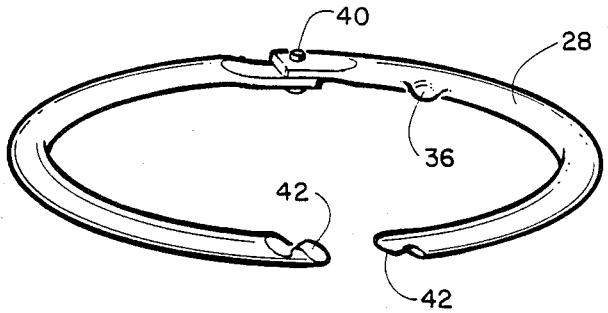
FIG. 3 is an elevated showing of the split ring of the fastener removed from the base.

As can be seen in FIG. 3, the ring 28 splits at the split 38 and the sides of the ring are than free to rotate away from each other about pivot or hinge 40 so that perforated papers can be added or removed from the rings in a conventional manner. At the ends of the rings at the split a locking device 42 is employed. The locking device comprises a conventional snap lock with nesting surfaces positioned on the ends of the rings at the split. As with conventional locks of this type the segments of the ring on each side of the split are forced apart to open the ring.

As can be seen in FIG. 1, as the rings accommodate papers thereon the angle of the rings from the file surface increase until the rings are at an angle 90 degrees from the surface of the file as with a conventional fixed ring loose leaf binder. It should be understood that with any amount of papers attached to the rings that the rings can manually be elevated to the 90 degree position and any selected paper can then be removed therefrom without the removal of any papers adjacent thereto and the rings can be pivoted to a minimum angle relative to the folder surface for filing of the folder.

The embodiment of the invention particularly disclosed and described hereinabove is presented merely as an example of the invention. Other embodiments, forms and modifications of the invention coming within the scope and spirit of the appended claims will, of course, readily suggest themselves to those skilled in the art.

What is claimed is:

1. A loose leaf fastener for temporary storage of perforated paper thereon comprising:

a base member having spaced apart bores equal in number and spaced distance to the perforations in said perforated paper, said bores being directed parallel to each other and transverse to the longitudinal dimension of said base member;

a circumferential split ring pivotal between ring open and ring closed positions loosely carried in each of said bores for freedom of side to side pivoting relative thereto toward and away from said base member; and position locking means carried by said ring and located on each outer side of said bore for preventing said ring from rotating along its circumference relative to said bore.

2. The invention as defined in claim 1 additionally including means for attaching said base member to an object.

3. The invention as defined in claim 2 wherein said means for attaching said base member to an object is integral to said base member.

4. The invention as defined in claim 1 wherein said split ring includes a pivot for pivoting portions of said ring between ring open and ring closed positions and said pivot comprises one of said position locking means.

5. The position locking means of claim 1 comprise increased diameter areas located on the cirumference of said split ring.

6. The invention as defined in claim 2 wherein said object is a conventional file folder and said means for attaching said fastener to said folder comprises base member ends that fold perpendicular to said base member and are insertable through apertures in said folder and then folded further toward each other to a position substantially parallel with the surface of said folder whereby said base is held fast to the folder.

* * * * *